US005165555A

United States Patent [19]

Anatalio

[11] Patent Number: 5,165,555

[45] Date of Patent: Nov. 24, 1992

[54] MULTIPLE STACKABLE SWINGABLE NON-SLIP CANTILEVER PANTS HANGER SYSTEM

[76] Inventor: Perfecto T. Anatalio, 55 Sugar Hill Dr., Hillsborough, Calif. 94010

[21] Appl. No.: 671,487

[22] Filed: Mar. 19, 1991

Related U.S. Application Data

[63] Continuation-in-part of Ser. No. 387,945, Jul. 31, 1989, abandoned.

[51] Int. Cl.[5] ..... A47F 5/00

[52] U.S. Cl. ..... 211/96; 211/105.1

[58] Field of Search ..... 211/96, 100, 105.1, 211/171, 168

[56] References Cited

U.S. PATENT DOCUMENTS

| | | | |
|---|---|---|---|
| 586,977 | 7/1897 | Sibley . | |
| 724,427 | 4/1903 | Bonsall . | |
| 761,893 | 6/1904 | Lee . | |
| 1,097,755 | 5/1914 | Goldsmith . | |
| 1,208,986 | 12/1916 | Krodel . | |
| 2,052,606 | 1/1936 | Comstock | 211/123 |
| 2,194,191 | 3/1940 | Wolf | 211/96 |
| 2,409,956 | 10/1946 | Ramstack | 223/96 |
| 2,465,859 | 5/1949 | Fidler | 211/89 |
| 2,595,521 | 5/1952 | Hanson . | |
| 2,598,502 | 5/1952 | Butler | 211/101 |
| 2,610,742 | 9/1952 | Stanton | 211/89 |
| 2,786,579 | 3/1957 | Wright | 211/89 |
| 2,926,824 | 3/1960 | St. Clair | 223/95 |
| 3,118,544 | 1/1964 | Franklin | 211/102 |
| 3,294,248 | 12/1966 | Olson | 211/96 |
| 3,333,711 | 8/1967 | Helmer | 211/96 |
| 3,550,784 | 12/1970 | Batts | 211/116 |
| 3,635,352 | 1/1972 | Brooks | 211/47 |
| 4,209,156 | 6/1980 | Kashden | 248/289 |
| 4,360,109 | 11/1982 | Kurtz | 211/100 |
| 4,569,450 | 2/1986 | Dillingham | 211/96 |
| 4,720,016 | 1/1988 | Kay | 211/96 |
| 4,723,665 | 2/1988 | Benedict | 211/168 |
| 4,856,661 | 8/1989 | Guillen | 211/100 |

FOREIGN PATENT DOCUMENTS

| | | | |
|---|---|---|---|
| 536490 | 5/1922 | France | 211/96 |
| 286049 | 3/1928 | United Kingdom . | |

*Primary Examiner*—Robert W. Gibson, Jr.

[57] ABSTRACT

A multiple stackable swingable non-slip cantilever pants hanger system to fill in and to supply the tremendously large long-felt but unfilled and unsolved need for a affordably low cost multiple stackable swingable non-slip cantilever pants hanger system that efficiently utilize and organize to the optimum the wasted spaces between the bottom of hung-up shorts clothes and the floor of wardrobe closets in millions of homes that are built, being built, and to be built. The multiple stackable swingable non-slip cantilever pants hanger system comprise a plurality of I-shape stackable swingable non-slip cantilever pants hangers, a cantilever pants hanger channel-shape ledger beam wall support, and a plurality of pivot anchor means adapted to secure and pivot thereabout the stackable swingable non-slip cantilever pants hangers to the ledger beam wall support having being secured with wall attachment means to the vertical wall whereby pants or skirts of similar clothes can be suspended thereover or retrieved therefrom.

2 Claims, 6 Drawing Sheets

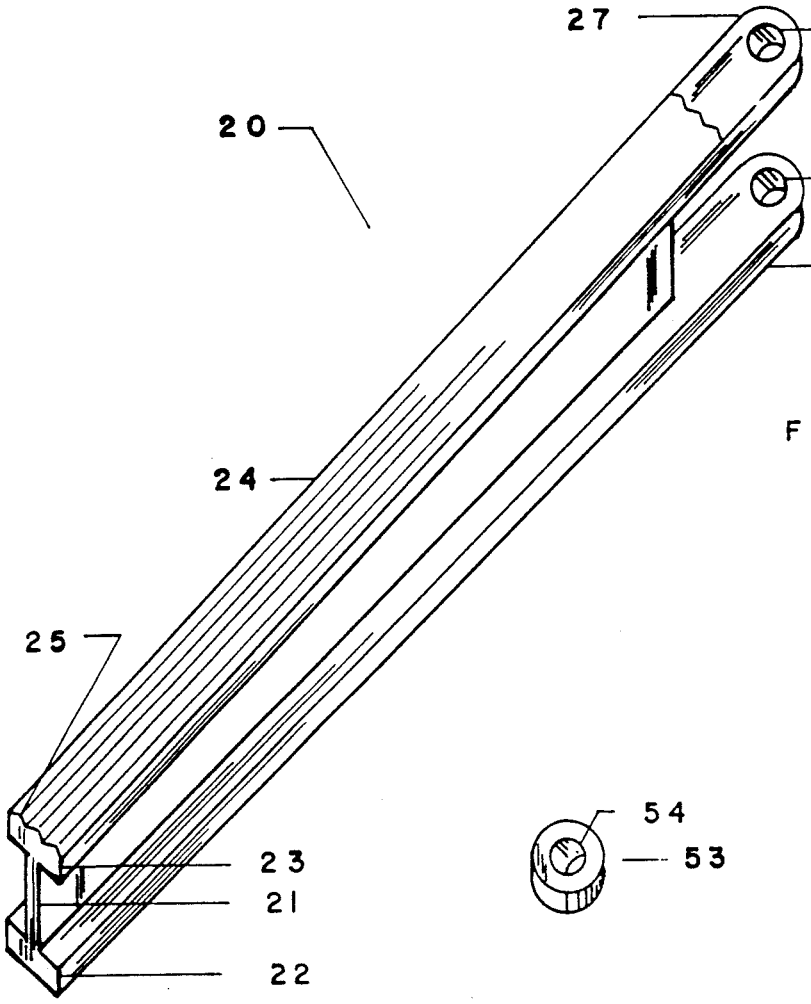
F I G. 2
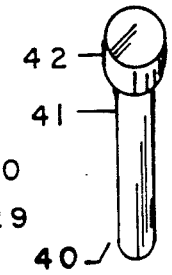
F I G. 3
F I G. 4
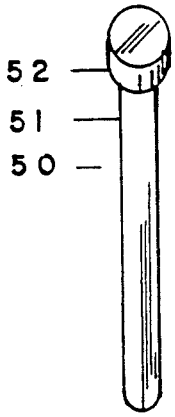
F I G. 5
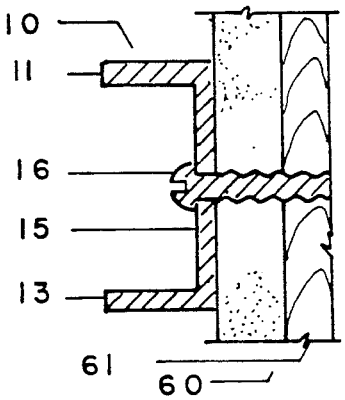
F I G. 6
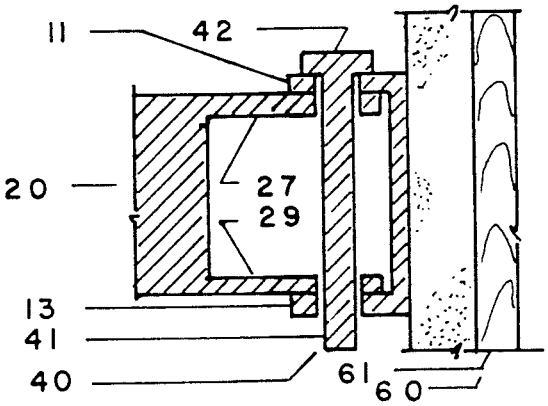
F I G. 7

MULTIPLE STACKABLE SWINGABLE NON-SLIP CANTILEVER PANTS HANGER SYSTEM

This application is a continuation in part of Ser. No. 07/387,945, Jul. 31, 1989, now abandoned.

FIELD OF INVENTION

This invention relates to pants hangers and more particularly to a multiple stackable swingable non-slip cantilever pants hangers system that seeks to fill in and to supply the tremendously large long-felt but unfilled and unsolved need for a simple, affordably low price, convenient to use, and aesthetically pleasing swingable multipants hanger system that efficiently utilize and organize to the optimum , without the expensive removal of the in-place conventional single shelf storage space required of prior art multi-pants hanger systems, the wasted spaces between the bottom of hung-up short clothes and the floor of wardrobe closets in millions of homes that are built, being built, and to be built.

BACKGROUND OF PRIOR ARTS

The conventional wardrobe closets are commonly equipped with a single shelf and a single rod in accordance with the American Institute of Architects graphic standards. Since a combination of long and short clothes supported on conventional garment hangers must be suspended from the single rod and since the single rod must be supported at its ends and at midspan, only a single rod can be installed in any wardrobe closet, thus the space between the bottom of short hung-up clothes and the floor of wardrobe closets are wasted. Further, when many clothes are suspended on the single rod it is inconvenient and difficult either to remove and insert clothes without spreading apart the hangers to the left from those to the right of the desired hanger to create sufficient room therebetween for the removal or insertion of the hanger in question.

Heretofore, many prior art swingable multi-pants hanger system have been invented to efficiently utilize and organize the wardrobe closets. However, while the referred prior art pant hanger systems do achieve various design goals, made an efficient utilization of the wardrobe closets, and have eliminated the need for the user to spread apart the hangers to the left from those to the right to create sufficient room therebetween for the removal or the insertion of the hanger in question, these multi-pants hanger systems nevertheless suffer from one or more of the following drawbacks:

1. Failure to recognize and supply the tremendously large long-felt but unfilled and unsolved need for a simple, low cost to manufacture and install, and convenient to use affordably low price multipants hanger system for wardrobe closets.
2. Failure to design and manufacture a affordably low price multiple swingable non-slip cantilever pants hanger system that fits within and efficiently utilize and organize to the optimum, without the expensive removal of the in-place conventional single shelf storage space required of prior art multi-pants hanger systems, the vasted spaces between the bottom of hung-up short clothes and the floor of wardrobe closets in millions of homes that are built, being built, and to be built.
3. Failure to design a multiple stackable swingable non-slip cantilever pants hanger system that could be vertically stacked to fit within and to efficiently utilize and organize to the optimum, the still under utilize wasted spaces left out between the bottom of hung-up short clothes and the top of the first level stackable swingable non-slip cantilever pants hangers in place.
4. Failure to recognize the high cost, complexity, and difficulty of manufacture and installation of prior art multi-pants hanger systems.

SUMMARY OF THE INVENTION

It is a general object of this invention to fill in and to supply the tremendously large long-felt but unfilled and unsolved need for a multiple stackable swingable non-slip cantilever pants hanger system that could be horizontally and vertically stacked to efficiently utilize and organize to the optimum, without the expensive removal of the in-place conventional single shelf storage space required of prior art multi-pants hanger systems, the wasted spaces between the bottom of hung-up short clothes and the floor of wardrobe closets in millions of homes that are built, being built, and to be built.

It is further object of this invention to provide a horizontal multiple stackable swingable non-slip cantilever pants hanger system that could be stacked vertically as required or desired to fully utilize the still under utilized wasted spaces left out between the bottom of hung-up short clothes and the top of the first level stackable swingable non-slip cantilever pants hangers in place.

It is still further object of this invention to provide a first multiple stackable swingable non-slip cantilever pants hanger system that is simple in construction and low in cost to manufacture to sell at affordably low price to be conducive to widespread use.

It is still further object of this invention to provide a first stackable swingable non-slip cantilever pants hanger system that is simple and low in cost to install to induce architects, home designers, merchant home builders, and home owners to have and specify in all wardrobe closets.

It is still further object of this invention to provide a multiple stackable swingable non-slip cantilever pants hanger system that is aesthetically pleasing, and simple and a pleasure to use.

It is still further object of this invention to provide a multiple stackable swingable non-slip cantilever pants hanger system which overcomes the shortcomings and disadvantages of the prior art multi-pants hanger systems.

To achieve the objects of this invention, a multiple stackable swingable non-slip cantilever pants hangers system is provided which comprises:

a horizontal cantilever pants hanger wall support comprising a ledger beam of rigid materials. The wall support comprise preferably a cost efficient structurally engineered rigid channel-shape ledger beam. The channel shape wall support comprise a vertical web with a horizontal top flange and a horizontal bottom flange extending perpendicularly from the vertical web. The vertical web includes a plurality of wall attachment means for securing the ledger beam wall support to the vertical wall preferably to the wall vertical stud for best wall attachment thereof. The top flange includes a plurality of vertical apertures extending therethrough formed in a laterally closed space relationship therealong the ledger beam wall support. The bottom flange includes a plurality of vertical apertures extending therethrough formed in a laterally closed space relationship therealong the ledger beam wall support. The apertures in the top flange has a corresponding vertically aligned apertures in the bottom flange. The diameter of the top flange apertures and the diameter of the bottom flange apertures are of the same diameter size. The aperture diameter of the flanges are slightly bigger than the diameter of the pivot portion of the pivot anchor means thru which aperture the pivot portion extends therethrough to pivotally secure the pivot portion in the ledger beam wall support. The vertical clear space between the bottom of the top flange and the top of the bottom flange of the ledger beam wall support is slightly higher than the designed vertical clear height of the stackable swingable non-slip cantilever pants hanger through clear space the stackable swingable non-slip cantilever pants hangers are installed wherein when the apertures in the ledger beam wall support and the apertures in the stackable swingable non-slip cantilever pants hangers are vertically aligned the pivot portion can be inserted into the apertures to pivotally anchor the stackable swingable non-slip cantilever pants hangers to the ledger beam wall support having being secured with wall attachment means to the vertical wall. The ledger beam wall support comprise preferably a cost efficient structurally engineered rigid channel shape injection molded plastic beam for low cost, aesthetically pleasing appearance, and best quality.

a plurality of stackable swingable non-slip cantilever pants hangers comprising a horizontal elongated cantilever beam of rigid materials. The stackable swingable non-slip cantilever pants hangers comprise preferably a cost efficient structurally engineered rigid T-shape beam. The T shape stackable swingable non-slip cantilever pants hangers comprise a central vertical web with a horizontal top flange and a horizontal bottom flange. The T shape stackable swingable non-slip cantilever pants hangers include a horizontal elongated beam pants hanger portion terminating at its end thereof, and a pivot anchorage portion. The horizontal elongated beam pants hanger portion includes a top flange provided with anti-slip means for preventing the slippage of pants in draped condition suspended thereover. The pivot anchorage portion includes a top flange lug and a bottom flange lug each formed from the horizontal extension of the top flange and the bottom flange approximately half inch beyond the I shape beam web cutoff. The top flange lug and the bottom flange lug are each provided with a vertical aperture extending therethrough. The aperture in the top flange lug is vertically aligned with the aperture in the bottom flange lug. The aperture diameter in the top flange lug and the aperture in the bottom flange lug are of the same diameter. The aperture diameter of the flange lugs are slightly bigger than the diameter of the pivot portion through which aperture the pivot portion extends therethrough to pivotally anchor the stackable swingable non-slip cantilever pants hangers to the pivot portion having being secured to the ledger beam wall support. The apertures in the flange lugs are being tight enough to permit the stackable swingable non-slip cantilever pants hangers to remain in any angular position while being free enough to be turned into a desired angular orientation without wobbling. The designed vertical clear height of the stackable swingable non-slip cantilever pants hangers is slightly less than the vertical clear space between the bottom of the top flange and the top of the bottom flange of the ledger beam wall support through which vertical clear space the stackable swingable non-slip cantilever pants hangers are installed wherein when the apertures in the ledger beam wall support and the apertures in the stackable swingable non-slip cantilever pants hangers are vertically aligned the pivot portion of the pivot anchor means can be inserted into the apertures to pivotally anchor the stackable swingable non-slip cantilever pants hangers to the ledger beam wall support having being secured with wall attachment means to the vertical wall. The stackable swingable non-slip cantilever pants hangers follow the structural engineering practice and taper progressively toward the distal end thereof. Following further the conventional structural engineering practice the stackable swingable non-slip cantilever pants hangers are cambered slightly to remain slightly above horizontal when pants in draped condition are suspended thereover in aesthetically pleasing appearance of structural integrity. The stackable swingable non-slip cantilever pants hangers comprise preferably a cost efficient structurally engineered rigid cambered tapered I shape injection molded plastic beam for lowest cost, aesthetically pleasing appearance and best quality. It should be noted that the stackable swingable non-slip cantilever pants hangers being cambered and tapered only the injection molded plastic manufacturing process could produce accurately and repeatedly stackable swingable non-slip cantilever pants hangers at very low cost in a single highly automatic operation. In one single injection mold one ledger beam wall support, a plurality of stackable swingable non-slip cantilever pants hangers and a plurality of pivot anchor means could be produced accurately and repeatedly in a single highly automatic operation with only one operator.

a plurality of pivot anchor means comprising a structurally engineered solid round pins comprising a cap portion and a pivot portion. The cap portion thickness is approximately eight of an inch. The diameter of the cap portion is larger than the diameter of of the apertures in the flange lugs of the stackable swingable non-slip cantilever pants hangers and the apertures in the flanges of the ledger beam wall support so that only the pivot portion of the pivot anchor means can be inserted therethrough the apertures. The diameter of the pivot portion is slightly smaller than the diameter of the apertures in the flanges of the ledger beam wall support. The diameter of the pivot portion is slightly smaller than the diameter of the apertures in the flange lugs of the stackable swingable non-slip cantilever pants hangers. The pivot portion is adapted to be received in the apertures in the flanges of the ledger beam wall support and the apertures in the flange lugs of the stackable swingable non-slip cantilever pants hangers whereby when the apertures of the ledger beam wall support and the apertures of the stackable swingable non-slip cantilever pants hangers are vertically aligned the pivot portion can be inserted into the apertures to pivotally anchor the stackable swingable non-slip cantilever pants hangers to the ledger beam wall support having being secured with wall attachment means to the vertical wall whereby pants, skirts, or similar clothes in drapes condition can be suspended thereover. The pivot portion has approximately half inch projection below the bottom of the bottom flange of the ledger beam wall support.

The wasted spaces between the bottom of hung-up short clothes and the floor of wardrobe closets in millions of homes that are built, being built, and to be built can therefore be efficiently utiltized and organized to the optimum, without the expensive removal of the in-place conventional single shelf storage space required of prior art mulit-pants hanger systems, with the installation of this invention. It should be noted that the pivotal movement of each stackable swingable non-slip cantilever pants hangers independent of others stackable swingable non-slip cantilever pants hangers thereof allow each stackable swingable non-slip cantilever pants hangers to be projected in a separate direction radially from the pivot portion so as to allow easy and convenient access for suspending or retrieving the pants therefrom.

BRIEF DESCRIPTION OF THE DRAWINGS

Other objects and many of the advantages of this invention will be readily appreciated as the same become better understood by reference to the following detailed description when considered in connection with the following drawings:

FIG. 2 shows a perspective view of tapered I-shape stackable swingable non-slip cantilever pants hanger.

FIG. 3 shows a perspective view of a pivot anchor means for a single level stackable swingable non-slip cantilever pants hangers system.

FIG. 4 shows a perspective view of a spacing washers used in multi-level stackable swingable non-slip cantilever pants hangers system.

FIG. 5 shows a perspective view of a pivot anchor means for a multi-level stackable swingable non-slip cantilever pants hangers system.

FIG. 6 shows a cross sectional view of a channel-shape ledger beam wall support secured with wall attachment means to the wall.

FIG. 7 shows a cross sectional view of a I-shape stackable swingable non-slip cantilever pants hanger pivotally anchored with a pivot anchor means to a channel-shape ledger beam wall support.

DESCRIPTION OF THE PREFERRED EMBODIMENTS

Figure 1:
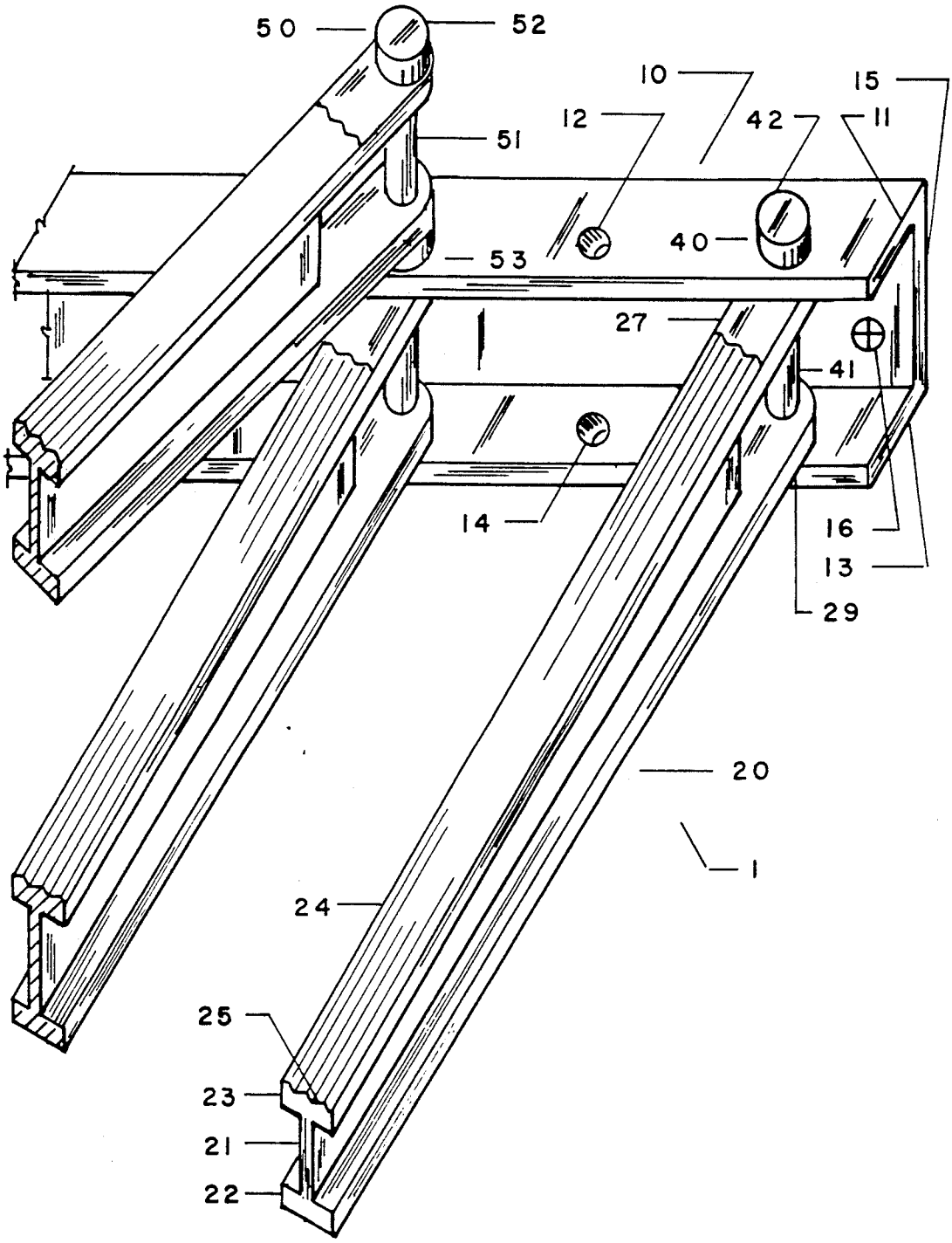
FIG. 1 shows a perspective view of a preferred wardrobe closet multiple stackable swingable non-slip cantilever pants hanger system 1 comprising a plurality of closely spaced tapered I-shape stackable swingable non-slip cantilever pants hangers pivotally anchored with removable pivot anchor means to a channel-shape ledger beam wall support.
Figure 8:
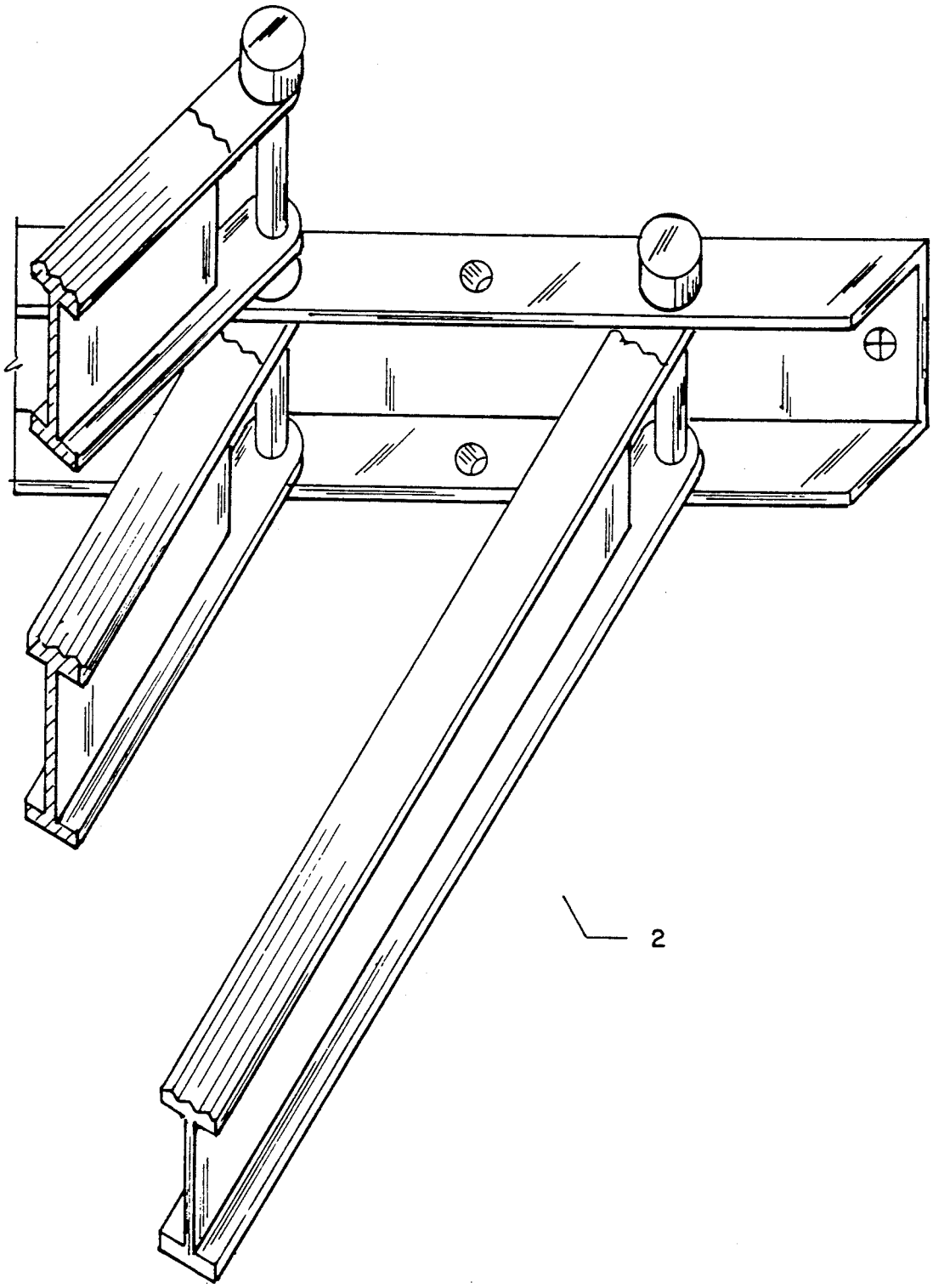
FIG. 8 shows a perspective veiw of another wardrobe closet multiple stackable swingable non-slip cantilever pants hangers system 2 comprising a plurality of a closely spaced constant height I-shape stackable swingable non-slip cantilever pants hangers pivotally anchored with a removable pivot anchor means to a channel-shape ledger beam wall support.
Figure 9:
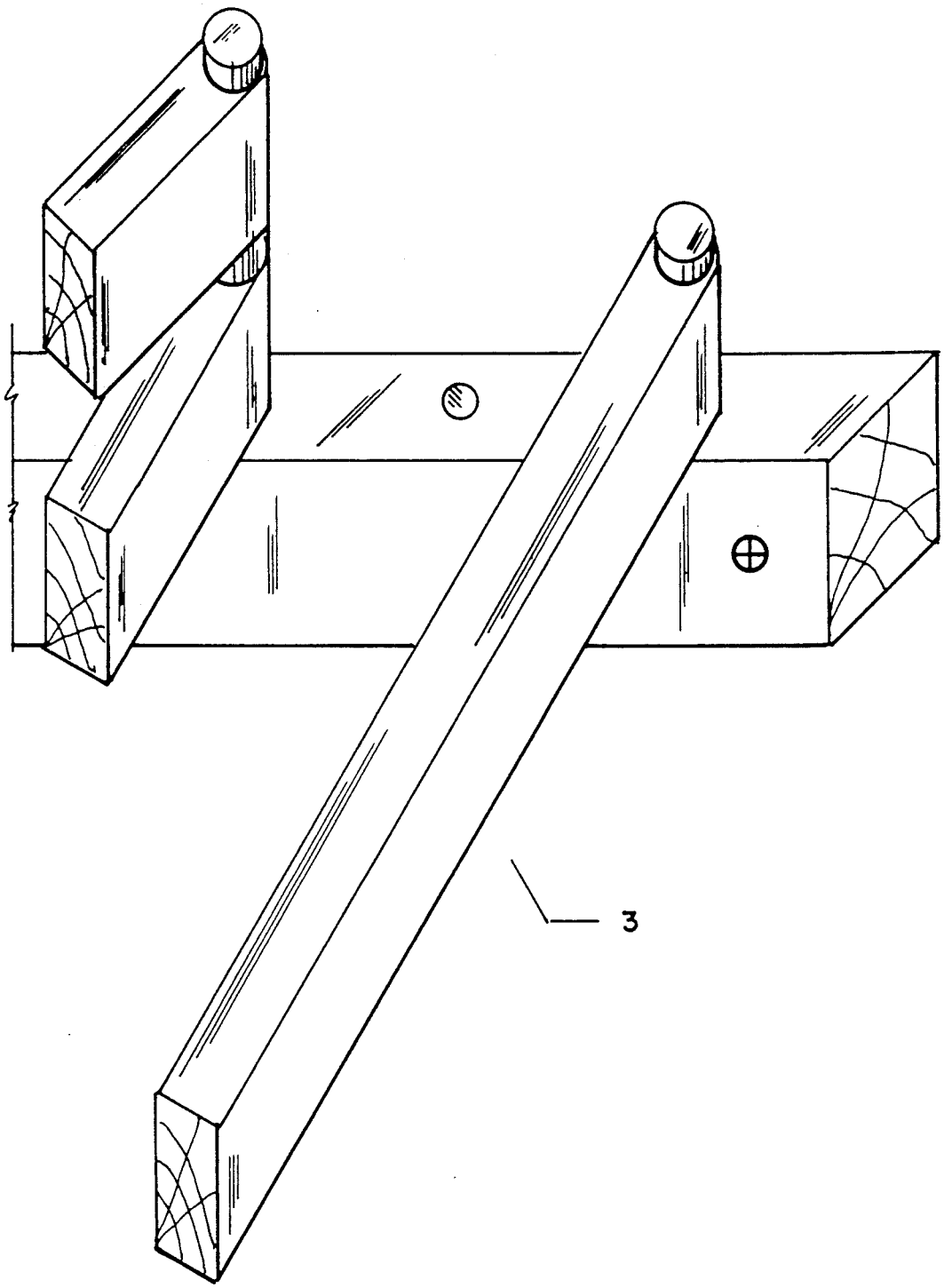
FIG. 9 shows a perspective view of another wardrobe closet multiple stackable swingable non-slip cantilever pants hangers system 3 comprising a plurality of a closely spaced solid rectangular wood stackable swingable non-slip cantilever pants hangers pivotally anchored with a removable pivot anchor means to a solid rectangular wood ledger beam wall support.
Figure 10:
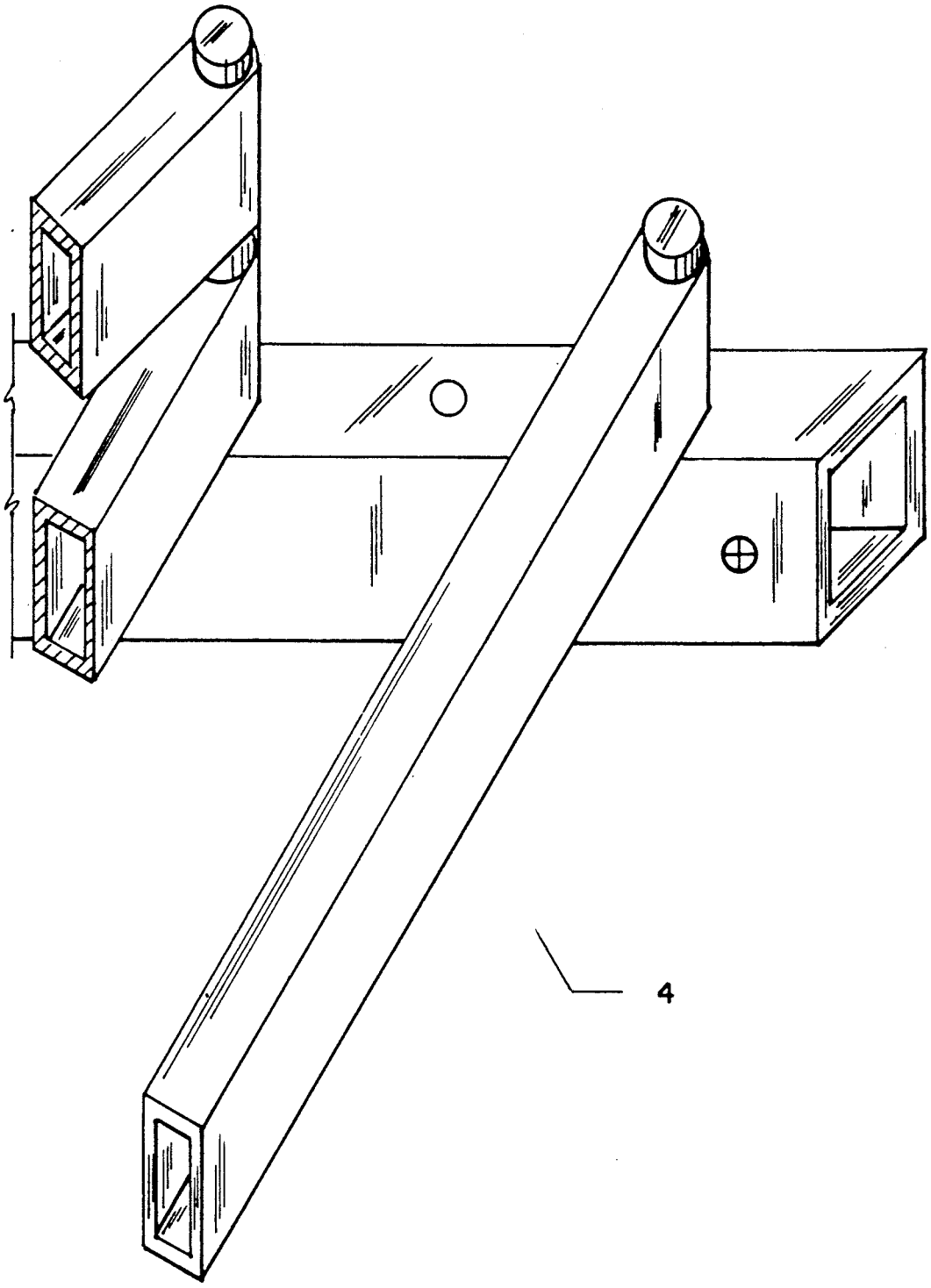
FIG. 10 shows a perspective view of another wardrobe closet multiple stackable swingable non-slip cantilever pants hanger system 4 comprising a plurality of closely spaced hollow rectangular stackable swingable non-slip cantilever pants hangers pivotally anchored with removable pivot anchor means to low rectangular ledger beam wall support.
Figure 11:
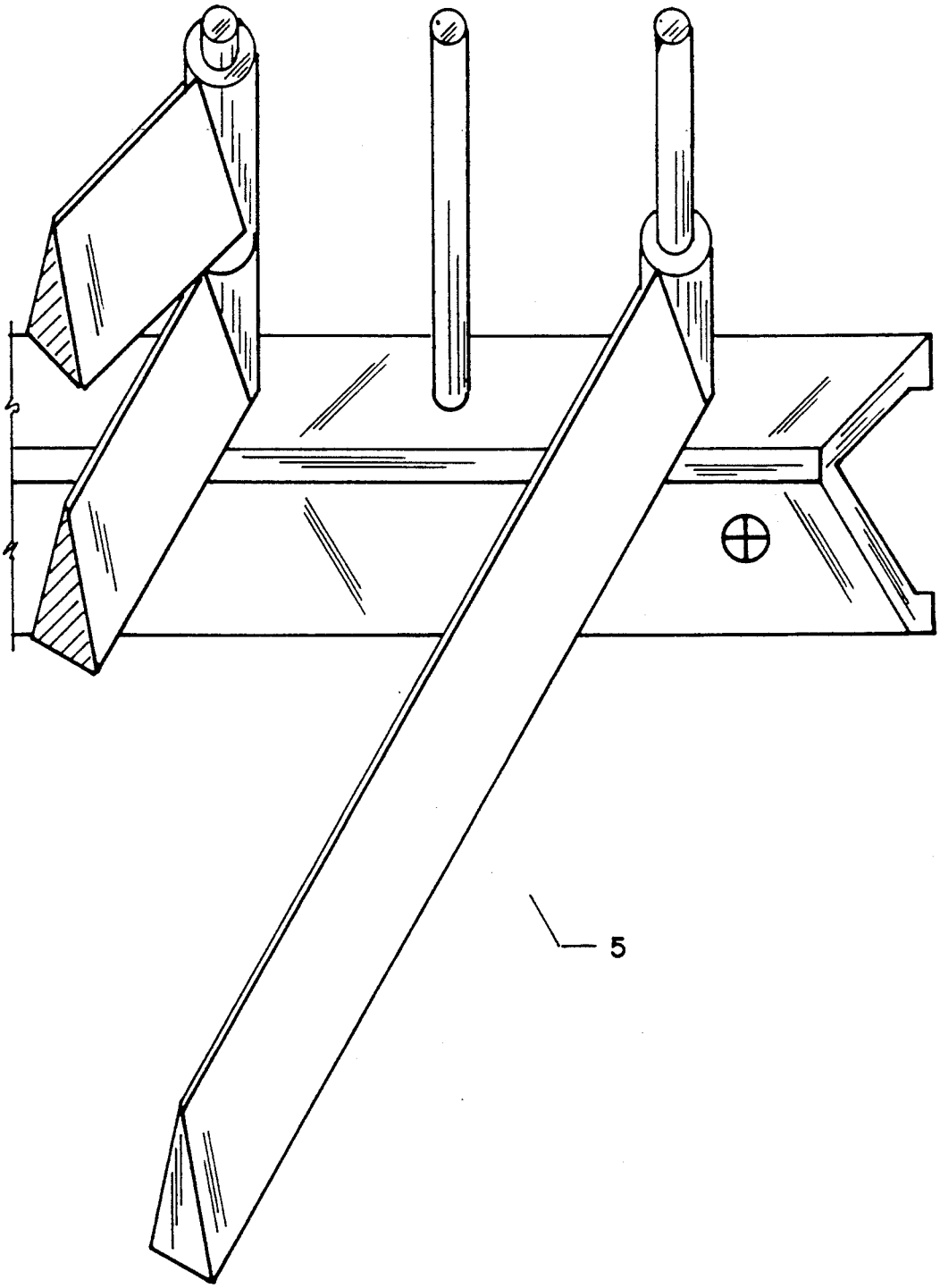
FIG. 11 shows a perspective view of another wardrobe closet multiple stackable swingable non-slip cantilever pants hangers system 5 comprising a plurality of closely spaced triangular solid stackable swingable non-slip cantilever pants hangers pivotally anchored with pivot anchor means integral with the open shape ledger beam wall support.

FIG. 1 shows a preferred wardrobe closet multiple stackable swingable non-slip cantilever pants hangers system 1 comprising

- a horizonatal cantilever pants hangers ledger beam wall support 10,
- a plurality of closely spaced stackable swingable non-slip cantilever pants hangers 20,
- a plurality of spacing washers 53, and
- a plurality of single level pivot anchor means 40 and multi-level pivot anchor means 50 each adapted to be received into the apertures 12 and 14 in the flanges 11 and 13 of the ledger beam wall support 10 and the apertures 28 and 30 in the flange lugs 27 and 29 of the stackable swingable non-slip cantilever pants hanger 20 whereby when the apertures 12 and 14 of the ledger beam wall support 10 and the apertures 28 and 30 of the stackable swingable non-slip cantilever pants hangers 20 are vertically aligned the pivot portion 41 of the pivot anchor means 40 or the pivot portion 51 of the pivot anchor means 50 are inserted thereinto the apertures to install, secure, and pivot thereabout the stackable swingable non-slip cantilever pants hangers 20 in the ledger beam wall support 10 having being secured with wall attachment means 16 to the vertical wall 60 whereby pants in draped condition are suspended thereover or retrieved therefrom to efficiently utilize and organize to the optimum, without the expensive removal of the in-place conventional single shelf storage space required of prior art multi-garment hanger systems, the wasted spaces between the bottom of hung-up short clothes and the floor of wardrobe closets in millions of homes that are built, being built, and to be built.

The horizontal cantilever pants hangers ledger beam wall support 10 as shown in FIG. 1 and FIG. 6 and best shown in FIG. 1 comprise a ledger beam of rigid materials. The ledger beam wall support 10 comprise preferably a cost efficient structurally engineered rigid channel-shape beam. The channel-shape ledger beam wall support 10 comprises:

- a vertical web 15 with a horizontal top flange 11 and a horizontal bottom flange 13 extending perpendicularly from the vertical web 15. The top flange 11 includes a plurality of vertical apertures 12 extending there through formed in a laterally closed space relationship therealong the ledger beam wall support 10 length. The bottom flange 13 includes a plurality of vertical apertures 14 extending therethrough formed in a laterally closed space relationship therealong the ledger beam wall support 10 length. Each of the apertures 12 in the top flange 11 has a corresponding vertically aligned apertures 14 in the bottom flange 13. The diameter of the apertures 12 in the top flange 11 and the diameter of the apertures 14 in the bottom flange 13 are of the same diameter size. The diameters of the apertures 12 and 14 are slightly bigger than the diameter of the pivot portion 41 of the pivot anchor means 40 and the diameter of the pivot portion 51 of the pivot anchor means 50 whereby through which apertures the pivot portion 41 and pivot portion 51 extends to install and secure pivotally the pivot portion 41 and pivot portion 51 in the apertures 12 and 14 of the ledger beam wall support 10. The vertical clear space between the bottom of the top flange 11 and the top of the bottom flange 13 is approximately one eight of an inch higher than the vertical clear height of the stackable swingable non-slip cantilever pants hangers 20 whereby in which vertical clear space the stackable swingable non-slip cantilever pants hangers 20 are installed, secured and pivoted thereabout when the apertures 12 and 14 of the ledger beam wall support 10 and the apertures 28 and 30 of the stackable swingable non-slip cantilever pants hangers 20 are vertically aligned and the pivot portion 41 and pivot portion 51 are inserted thereinto the apertures. The ledger beam wall support 10 comprise preferably a cost efficient structurally engineered rigid channel shape injection molded plastic beam for lowest cost, aesthetically pleasing appearance, and best quality ;

The plurality o closely spaced stackable swingable non-slip cantilever pants hangers 20 as shown in FIG. 1, FIG. 2, and FIG. 7 and best shown in FIG. 2 comprise a horizontal cantilever beam of rigid materials. The rigid stackable swingable no-slip cantilever pants hangers 20 comprise a cost efficient structurally engineered rigid I-shape beam. The I-shape stackable swingable non-slip cantilever pants hangers 20 comprises:

a central vertical web 21 with a horizontal top flange 23 and a horizontal bottom flange 22. The I-shape stackable swingable non-slip cantilever pants hangers 20 includes a horizontally elongated beam pants hanger portion 24 terminating at one end thereof to, and a pivot anchorage portion 26. The horizontal elongated beam pants hanger portion 24 includes a top flange 23 with slightly rounded top surface provided with anti-slip means 25 adapted for preventing slippage of pants in draped condition suspended thereover. The pivot anchorage portion 26 includes a top flange lug 27 and a bottom flange 29 each formed from the horizontal extension of the top flange 23 and the bottom flange 22 approximately half inch beyond the I-beam web 21 cutoff. The top flange lug 27 and the bottom flange lug 29 each provided with a approximately semi-icicular distal end adapted to reduce the top flange 11 and the bottom flange 13 widths of the ledger beam wall support 10 and the clear distance therebetween the distal end and the face of the vertical web 15 of the ldger beam wall support 10. The top flange lug 27 and the bottom flange lug 29 each provided with a vertical aperture extending therethrough. The aperture 28 in the top flange lug 27 is vertically aligned with the aperture 30 of the bottom flange lug 29. The diameters of the aperture 28 in the top flange lug 27 and the aperture 30 in the bottom flange 29 are of the same diameter size. The diameters of the aperture 28 in the top flange lug 27 and the aperture 30 in the bottom flange lug 29 are slightly bigger than the diameters of the pivot portion of the pivot anchor means 40 and the pivot portion 51 of the pivot anchor means 50 whereby through which apertures the pivot portion 41 and the pivot portion 51 extends rherethrough to install, secure, and pivot thereabout the stackable swingable non-slip cantilever pants hangers 20 to the pivot portion 41 or pivot portion 51 having being secured to the aperture 12 in the top flange 11 and the aperture 14 in the bottom flange 13 of the ledger beam wall support 10 having being secured with wall attachment means 16 to the vertical wall 60 whereby pants or skirts or similar clothes in draped condition are suspended thereover or retrieved therefrom. The vertical height of the stackable swingable non-slip cantilever pants hangers 20 is approximately one eight of an inch shorter than the vertical clear space between the bottom of the top flange 11 and the top of the bottom flange 13 of the ledger beam wall support 10 whereby in which vertical clear space the stackable swingable non-slip cantilever pants hangers 20 are installed, secured, and pivoted thereabout when the apertures 12 in the top flange 11 and the apertures 14 in the bottom flange 13 of the ledger beam wall support 10 and the aperture 28 in the top flange lug 27 and the apertures 30 in the bottom flange lug 29 of the stackable swingable non-slip cantilever pants hanger 20 are vertically aligned the pivot portion 41 of the pivot anchor means 40 and the pivot portion 51 of the pivot anchor means 50 are inserted thereinto the apertures. The aperture swingable non-slip cantilever pants hangers 20 taper progressively toward the distal end adapted to save material cost and camber slightly adapted to remain slightly above horizontal when pants or skirts or similar clothes in draped condition are suspended thereover in aesthetically pleasing appearance of structural integrity in accordance with conventional structural engineering practice. The stackable swingable non-slip cantilever pnats hangers 20 comprise preferably a cost efficient structurally engineered rigid cambered tapered I-shape injection molded plastic beam for lowest cost, aesthetically pleasing appearance, and best quality. It must be apparent at this juncture that the stackable swingable non-slip cantilever pants hangers 20 having being cambered and tapered could only be produced accurately and repeatedly at lowest cost by injection molded plastic manufacturing process in a highly automatic operation with one machine and one operator.

The plurality of spacing washers 53 as shown in FIG. 1 and FIG. 4 and best shown in FIG. 4 comprise a circular disk of rigid materials. The rigid circular disk spacing washers 53 includes:

a outside diameter preferably equal to the diameter of the approximately semi-circular distal end of the flange lugs 27 and 29 of the stackable swingable non-slip cantilever pants hangers 20 and a inside diameter of aperture 54 preferably equal to the apertures 28 and 30 in the flange lugs 27 and 29 for aesthetically pleasing appearance. The height of the spacing washers 53 is approximately half inch adapted to provide clearance therebetween the stackable swingable non-slip cantilever pants hangers 20 with pants in draped condition suspended thereover and the bottom of the next higher level of stackable swingable non-slip cantilever pants hangers 20.

The plurality of pivot anchor means 40 as shown in FIG. 1 and FIG. 3 and best shown in FIG. 3 comprise a vertical beam of rigid materials. The rigid vertical beam pivot anchor means 40 comprise a structurally engineered solid round pin. The pivot means 40 comprise:

a cap portion 42, and a pivot portion 41. The diameter of the cap portion 42 is bigger than the diameter of the apertures 12 and 14 in the flanges of the ledger beam wall support 10 and the diameter of the apertures 28 and 30 in the flange lugs of the stackable swingable non-slip cantilever pants hangers 20 adapted so that only the pivot portion 41 can be inserted in the apertures. The thickness of the cap portion 42 is approximately an eight of an inch. The diameter of the pivot portion 41 is slightly smaller than the diameter of the apertures 12 and 14 in the flanges of ledger beam wall support 10 and diameter of the apertures 29 and 30 in the flange lugs of the stackable swingable non-slip cantilever pants hangers 20 whereby through which apertures the pivot portion 41 extends therethrough to install, secure, and pivot thereabout the stackable swingable non-slip cantilever pants hangers 20 installed therebetween the top flange 11 and bottom flange 13 of the ledger beam wall support 10 to the ledger beam wall support 10 having being secured with wall attachment means 16 to the vertical wall 60 whereby pants or skirts or similar clothes in draped condition are suspended thereover or retrieved therefrom. The pivot portion 41 preferably project approximately one fourth of an inch below the bottom flange 13 of the ledger beam wall support 10. The length of the pivot portion 41 includes the height of the ledger beam wall support 10 and the approximately one fourth of an inch projection below the bottom flange 13 of the ledger beam wall support 10.

The plurality of pivot anchor means 50 as shown in FIG. 1 amd FIG. 5 and best shown in FIG. 5 comprise a vertical cantilever beam of rigid materials. The rigid vertical cantilever beam pivot anchor means 50 comprise a structurally engineered solid round pin. The pivot anchor means 50 comprise:

a pivot portion 51, and a cap portion 52. The diameter of the cap portion 52 is bigger than the diameter of the apertures 12 and 14 in the flanges of the ledger beam wall support 10 and the diameter of the apertures 28 and 30 in the flange lugs of the stackable swingable non-slip cantilever pants hangers 20 adapted so that only the pivot portion 51 can be inserted in the apertures. Thickness of the cap portion 52 is approximately an eight of an inch. The diameter of the pivot portion 51 is slightly smaller than the diameter of the apertures 12 and 14 in the flanges of ledger beam wall support 10 and the diameter of the apertures 28 and 30 in the flange lugs of the stackable swingable non-slip cantilever pants hangers 20 whereby through which apertures the pivot portion 51 extends therethrouqh to install, secure, and pivot thereabout the stackable swingable non-slip cantilever pants 20 installed therebetween the top flange 11 and the bottom flange 13 of the ledger beam wall support 10 and the stackable swingable non-slip cantilever pants hangers 20 with spacing washers 53 interdisposed therebetween supported on topof the flange 11 of the ledger beam wall support 10 to the ledger beam wall support 10 having being secured with wall attachment means 16 to the vertical wall 60. The pivot portion 51 preferably project approximately half inch below the bottom of the bottom flange 13 of the ledger beam wall support 10 adapted to prevent accidental uplift of the pivot portion 51 out of the aperture 14 in the bottom flange 13 of the ledger beam wall support 10 during the lateral movement of the stackable swingable non-slip cantilever pants hangers 20. The length of the pivot portion 51 includes the approximate projection of half inch below the bottom flange 13, height of the ledger beam wall support 10, and the height of the stackable swingable non-slip cantilever pants hanger 20 with the spacing washers 53 interposed therebetween supported on top of the flange 11 of the of the ledger beam wall support 10.

The wasted spaces between the bottom of the hung-up short clothes and the floor of wardrobe closets in millions of homes that are built, being built, and to be built, can therefore be efficiently utilized and organized to the optimum, without the expensive removal of the in-place conventional single shelf storage space required of prior art multi-garment hangers systems, as follows:

1. Measure the length of the proposed pants to be suspended thereover.
2. Take half of this measurement and mark it on the rear closet wall.
3. Secure the bottom of the ledger beam wall support 10 with wall attachment means 16 to the vertical wall 60 at approximately on top of this mark.
4. Install the stackable swingable non-slip cantilever pants hangers 20 in the vertical clear space between the flanges of the ledger beam wall support 10 aligning the apertures 28 of the top flange lug 27 and the apertures 30 of the bottom flange lug 29 with those of the apertures 12 and 14 of the ledger beam wall support 10.
5. Insert the pivot portion 41 therethrough the apertures thereby pivotally securing the first level stackable swingable non-slip cantilever pants hangers 20 to the ledger beam wall support 10 whereby pants or skirts or similar clothes in draped condition can now be suspended thereover or retrieved therefrom by swinging the stackable swingalbe non-slip cantilever pants hangers 20 to the left from those to the right of the desired stackable swingable non-slip cantilever pants hangers 20.
6. In new construction of custom homes and for sale houses the ledger beam wall support 10 is preferably installed 30 approximately 30 inches above the floor. However, in new construction of custom homes and for sale houses the ledger beam wall support 10 is preferably installed immediately below the conventional single shelf anf rod while hung-up short clothes are suspended under the bottom of pants in draped condition suspended thereover the stackable swingable non-slip cantilever pants hangers 20 for a more convenient and efficient wardrobe design.
7. In multi-level stackable swingable non-slip cantilever pants hanger systems the pivot portion 51 is first inserted into the apertures 28 and 30 of the uppermost stackable swingable non-slip cantilever pants hangers 20, aperture 54 of spacing washer 53, and so on, and lastly into the aperture 12 of the ledger beam wall support 10, aperture 28 and 30 of the stackable swingable non-slip cantilever pants hangers 20 installed therebetween the flanges 11 and 13 of the ledger beam wall support 10.

It must be apparent at this juncture that the multiple stackable swingable non -slip cantilever pants hangers systems 1 to 5 inclusive as shown in FIG. 1, FIG. 8, FIG. 9, FIG. 10, and FIG. 11 of this invention are the first ever invented and the only multiple stackable swingable non-slip cantilever garment hanger system, more particularly multiple stackable swingable non-slip cantilever pants hangers system, to fit right in and efficiently utilize and organize to the optimum the wasted spaces between the bottom of hung-up short clothes and the floor of wardrobe closets, without the expensive removal of the in-place conventional single shelf storage space required of prior art multi-garment hangers systems, because the ledger beam wall support 10 with zerohigh stackable swingable non-slip cantilever pants hangers 20 pivotally secured thereon can be installed closed to the bottom of hung-up short clothes whereas patent 4209156 and patent 4720016 use of the conventional garment hangers required an additional headroom of approximately seven inches or patent 2926824 required removal and reinstallation of the pants hangers in the pants hanger wall support to suspend thereover or retrieve therefrom pants in draped condition required more headroom between the bottom of the hung-up short clothes and the top of patent 2926824 pants hangers. It must be apparent further that although systems 1 to 5 have met the objects of this invention only system 1 is described and specified for being the lowest cost overall because the systems 1 shape and form lends to a perfect injection molded plastic manufacturing process whereby a complete system 1 could be accurately and repeatedly produced in a single highly automatic operation.

As will be appreciated from the foregoing, the multiple stacakbel swingable non-slip cantilever pants hangers system 1, cantilever pants hanger ledger beam wall support 10, zero-high stackable swingable non-slip cantilever pants hangers 20, pivot anchor means 40, and the multi-level use spacing washers 53 and pivot anchor means 50 of this invention:

1. are simple in design and construction,
2. can be manufactured accurately and repeatedly in large quantities at low cost and be sold at affordably low price,
3. can be easily and conveniently installed at low cost.
4. can efficiently utilize and organize to the optimum the wasted spaces between the bottom of hung-up short clothes and the floor of wardrobe closets in millions of homes that are built, being built, and to be built without the expensive removal of the in-place conventional single shelf storage space required of prior art multi-garment hanger systems,
5. can easily, conveniently, and instantly double or increase the number of stackable swingable non-slip cantilever pants hangers 20 by merely stacking additional levels of stackable swingable non-slip cantilever pants hangers 20 over the first level of stackable swingable non-slip cantilever pants hangers 20,
6. are simple, convenient, and a pleasure to use whereby pants or skirts or similar clothes in draped condition can be suspended thereover or retrieved therefrom,
7. are aesthetically pleasing so highly desired in all homes.
8. can be used to suspend other than clothes such as kitchen towels, bath towels, display merchandise, and many other commericial, and industrial uses.

While the above descriptions contain many specialties, the reader should not construe these as limitations on the scope of this invention, but merely exemplifications of preferred embodiments thereof. Those skilled in the arts will envision many other possible variations are within its scope. For example: skilled artisans will readily be able to change injection molded plastic to other natural or man-made materials, change the I-shape stackable swingable non-slip cantilever pants hangers 20 to channel-shape beam, change the cantilever pants hanger ledger beam wall support 10 to solid or hollow circular disk support secured to the conventional single shelf and hanger rod, make the spacing washers 53 to intregral with stackable swingable non-slip cantilever pants hangers 20, change the flange lugs to vertical sleeves, make the channel shape ledger beam wall support 10 installed between the flanges lugs 27 and 29, make the top flange lug 27 supported on the top flange 11 while the bottom flange lug 30 above the bottom flange 13, make the stackable swingable non-slip cantilever pants hangers 20 pivoted on top of ledger beam wall support 10, and use any combination of the system 1 to 5 to make another stackable cantilever pants hangers. Accordingly the reader is requested to determine the scope of this invention by the appended claims and their legal equivalents, and not by the examples which have been given. All changes which come within the meaning and range of equivalency of the claims are intended to be embraced therein.

What is claimed is:

1. A single level wardrobe closet multiple stackable swingable non-slip cantilever pants hangers system comprising:

a cantilever pants hanger wall support, said wall support comprise a ledger beam of rigid materials, said ledger beam wall support comprises preferably a cost efficient structurally engineered rigid channel-shape beam comprising a vertical web with a horizontal top flange and a horizontal bottom flange extending perpendicularly from the vertical web, said top flange includes a plurality of vertical apertures extending therethrough formed in a laterally closed space relationship therealong said ledger beam wall support length, said bottom flange includes a pluraltiy of vertical apertures extending therethrouqh formed in a laterally closed space relationship therealong said ledger beam wall support, each of said apertures in said top flange has a corresponding vertically aligned said apertures in said bottom flange, the diameter of said apertures in said top flange and the diameter of said aperture in said bottom flange are of the same diameter size, said diameters of said apertures are slightly bigger than the diameter of the pivot portion of a pivot anchor means whereby through which said apertures said pivot portion of said pivot anchor means extends to install and secure pivotally said pivot portion in said apertures of said ledger beam wall support, the vertical clear space between the bottom of said top flange and the top of said bottom flange is higher than the vertical height of the stackable swingable non-slip cantilever pants hangers whereby in which said vertical clear space said stackable swingable non-slip cantilever pants hangers are installed, secured and pivoted thereabout when said apertures of said ledger beam wall support and the apertures of said stackable swingable non-slip cantilever pants hangers are vertically aligned and said pivot portion are inserted thereinto said apertures, said vertical web includes a plurality of wall attachment means adapted for securing said ledger beam wall support to the vertical wall preferably to the wall vertical studs for best wall attachment thereof;

a plurality of stackable swingable non-slip cantilever pants hangers comprising a horizontal cantilever beam of rigid materials, said rigid stackable swingable non-slip cantilever pants hangers comprise preferably a cost efficient structurally engineered rigid I-shape beam, comprising a central vertical web with a horizontal top flange and a horizontal bottom flange, said I-shape stackable swingable non-slip cantilever pants hangers include a horizontal elongated beam pants hanger portion terminating at one end thereof to, and a pivot anchorage portion, said horizontal elongated beam pants hanger portion includes a top flange provided with a antislip means adapted for preventing slippage of pants in draped condition suspended thereover, said pivot anchorage portion includes a top flange lug and a bottom flange lug each formed from the horizontal extension of said top flange and said bottom flange beyond said I-beam web cutoff, said top flange lug and said bttom flange lug each provided with a aproximately semi-circular distal end, said top flange lug and said bottom flange lug each provided with a vertical aperture extending therethrough, said aperture in said top flange lug is vertically aligned with said aperture of said bottom flange lug, the diameters of said aperture in said top flange lug and said aperture in said bottom flange lug are of the same diameter size, said diameters of said apertures in said top flange lug and said aperture of said bottom flange lug are slightly bigger than said diameters of said pivot portion of said pivot anchor means whereby through which said apertures said pivot portion extends therethrough to install, secure, and pivot thereabout said stackable swingable non-slip cantilever pants hangers to said pivot portion having being secured to said apertures in said top flange and said apertures in said bottom flange of said ledger beam wall support having being secured with wall attachment means to the vertical wall, said vertical height of said stackable swingable non-slip cantilever pants hangers is shorter than said vertical clear space between said bottom of said top flange and said top of said bottom flange of said ledger beam wall support whereby in which said clear space said stackable swingable non-slip cantilever pants hangers are isntalled, secured, and pivoted thereabout when said apertures of said ledger beam wall support and said apertures of said stackable swingable non-slip cantilever pants hangers are vertically aligned said pivot portion are inserted thereinto said apertures, said stackable swingable non-slip cantilever pants hangers taper progressively toward said distal end, said stackable swingable non-slip cantilever pants hangers comprise preferably a cost efficient structurally engineered rigid tapered injection molded plastic beam for lowest cost, aesthetically pleasing appearance, and best quality; and a plurality of said pivot anchor means adapted for securing and pivoting thereabout said stackable swingable non-slip cantilever pants hangers installed therebetween the flanges of said ledger beam wall support having being secured with wall attachment means to said vertical wall, said pivot anchor means comprise a vertical beam of rigid materials, said pivot anchor means comprise a structurally engineered solid round pin, said pivot anchor means comprise a pivot portion and a cap portion , the diameter of said cap portion is bigger than said diameter of said apertures in said flanges of said ledger beam wall support and said diameter of said apertures in said flange lugs of said stackable swingable non-slip cantilever pants hangers adapted so that only said pivot portion can be inserted in said apertures, the thickness of said cap portion is approximately an eight of an inch, said diameter of said pivot portion is slightly smaller than said diameter of said apertures in said flanges of said ledger beam wall support and said apertures in said flange lugs of said stackable swingable non-slip cantilever pants hangers whereby through said apertures said pivot portion extends to install, secure, and pivot thereabout said stackable swingable non-slip cantilever pants hangers installed therebetween said top flange and bottom flange of said ledger beam wall support having being secured with wall attachment means to said vertical wall whereby pants or skirts or similar clothes in draped condition are suspended thereover or retrieved therefrom, said pivot portion preferably projects approximately one fourth of an inch below said bottom flange of said ledger beam wall support, the length of said pivot portion includes said height of said ledger beam wall support and said approximately one fourth of an inch projection below said bottom of said ledger beam wall support.

2. A multi-level stackable swingable non-slip cantilever pant hangers system comprising:

a cantilever pants hanger wall support, said wall support comprises a ledger beam of rigid materials, said ledger beam wall support comprises preferably a cost efficient structurally engineered rigid channel-shape beam comprising a vertical web with a horizontal top flange and a horizontal bottom flange extending perpendicularly from the vertical web, said vertical web includes a plurality of wall attachment means adapted for securing said ledger beam wall support to the vertical wall preferably to a wall vertical stud for best wall attachment thereof, said top flange insludes a pluraltiy of vertical apertures extending therethrough formed in a laterally closed space relationship therealong said ledger beam wall support length, said bottom flange includes a plurality of vertical apertures extending therethrough formed in a laterally closed space relationship therealong said ledger beam wall support length, each of said apertures in said top flange has a corresponding vertically aligned said aperture in said bottom flange, the diameter of said apertures in said top flange and the diameter of said apertures in said bottom flange are of the same diameter size, said diameters of said apertures are slightly bigger than the diameter of the pivot portion of a pivot anchor means whereby through said apertures said pivot portion of said pivot anchor means extends to install and secure pivotally said pivot portion in said apertures of said ledger beam wall support, the vertical clear space between the bottom of said top flange and the top of said bottom flange is slightly higher than the vertical height of the stackable swingable non-slip cantilever pants hangers whereby in said vertical clear space said stackable swingable swingable non-slip cantilever pants hangers are installed, secured, and pivoted thereabout when said apertures of said ledger beam wall support and the apertures of said stackable swingable non-slip cantilever pants hangers are vertically aligned said pivot portion are inserted thereinto said appertures, said ledger beam wall support comprise preferably a cost efficient structurally engineered rigid channel-shape injection molded plastic beam for lowest cost, aesthetically pleasing appearance, and best quality:

a plurality of stackable swingable non-slip cantilever pants hangers comprising a horizontal cantilever beam of rigid materials, said rigid stackable swingable non-slip cantilever pants hangers comprise preferably a cost efficient structurally engineered rigid I-shape beam comprising a central vertical web with a horizontal top flange and a horizontal bottom flange, said I-shape stackable swingable non-slip cantilever pants hangers includes a horizontal elongated beam pants hanger portion terminating at one end thereof to, and a pivot portion anchorage portion, said horizontal elongated beam pants portion includes a top flange provided with anti-slip means adapted for preventing slippage of pants in draped condition suspended thereover, said pivot anchorage portion includes a top flange lug and a bottom flange lug each formed from the horizontal extension of said top flange and said bottom flange beyond said I-beam web cutoff, said top flange lug and said bottom flange lug each provided with a approximately semi-circular distal end, said top flange lug and said bottom flange lug each provided with a vertical aperture extending therethrough, said aperture in said top flange lug is vertically aligned with said aperture of said bottom flange lug, the diameters of said aperture in said top flange lug and said bottom flange lug are of the same diameter size, said diameters of said aperture in said top flange lug and said aperture of said bottom flange lug are slightly bigger than said diameters of said pivot portion of said pivot anchor means whereby through said apertures said pivot portion extends therethrough to install, secure, and pivot thereabout said stackable swingable non-slip cantilever pants hangers installed therebetween said flanges of ledger beam wall support and said stackable swingable non-slip cantilever pants with spacing washers interposed therebetween supported on top of said ledger beam wall support to said pivot portion having being secured to said apertures in said top flange and said bottom flange of said ledger beam wall support having being secured with wall attachment means to said vertical wall, said vertical height of said stackable swingable non-slip cantilever pants hangers is slightly shorter than said vertical clear space between said bottom of said top flange and said top of said bottom flange of said ledger beam wall support whereby in which said clear space said stackable swingable non-slip cantilever pants hangers are installed, secured, and pivoted thereabout when said apertures of said ledger beam wall support and said apertures of said stackable swingable non-slip cantilever pants hangers and said apertures of said stackable swingable non-slip cantilever pants hangers with said spacing washers interposed theretween supported on top of said ledger beam wall support are vertically aligned said pivot portion are inserted thereinto said apertures, said stackable swingable non-slip cantilever pants hangers taper progressively toward said distal end, said stackable swingable non-slip cantilever pants hangers comprise preferably a cost efficient structurally engineered rigid tapered injection molded plastic beam for lowest cost, aesthetically pleasing appearance, and best quality; and a plurality of said pivot anchor means adapted for securing and pivoting thereabout said stackable swingable non-slip cantilever pants hangers installed between said flanges of said ledger beam wall support and said stackable swingable non-slip cantilever pants hangers with spacing washers interposed therebetween supported on top of said ledger beam wall support having being secured with wall attachment means to said vertical wall, said pivot anchor means comprise a vertical cantilever beam of rigid materials, said rigid vertical cantilever pivot anchor means comprise a structurally engieered solid round pin, said pivot anchor means a pivot portion and a cap portion, the diameter of said cap portion is bigger than said diameter of said apertures in said flanges of said ledger beam wall support and said diameter of said apertures in said flange lugs of said stackable swingable non-slip cantilever pants hangers adapted so that only said pivot portion can be inserted in said apertures, the thickness of said cap portion is approximately eight of an inch, said diameter of said pivot portion is slightly smaller than said diameter of said apertures in said flanges of said ledger beam wall support and said apertures in said flange lugs of said stackable swingable non-slip cantilever pants hangers whereby through said apertures said pivot portion extends to install, secure, and pivot thereabout said stackable swingable non-slip cantilever pants hangers installed therebetween said top flange and said bottom flange of said ledger beam wall support and said stackable swingable non-slip cantilever pants hangers with said spacing washers interposed therebetween supported on top of said ledger beam wall support having being secured with wall attachment means to said vertical wall, said pivot portion preferably projects approximately half of an inch below the bottom of said bottom flange of said ledger beam wall support adapted to prevent accidental uplift of said pivot portion out of said aperture in said bottom flange of said ledger beam during lateral movement of said stackable swingable non-slip cantilever pants hangers, the length of said pivot portion includes said approximate half of an inch projection below said bottom of said flange of said ledger beam wall support, height of said ledger beam wall support and height of said stackable swingable non-slip cantilever pants with said spacing washers interposed therebetween supported on top of said ledger beam wall support.

* * * * *